US005131652A

United States Patent [19]

Peng

[11] Patent Number: 5,131,652

[45] Date of Patent: Jul. 21, 1992

[54] SHOCK ABSORBING RACKET HANDLE

[76] Inventor: Jung-Ching Peng, 17, Tai Lung Road, Taichung City, Taiwan

[21] Appl. No.: 645,811

[22] Filed: Jan. 25, 1991

[51] Int. Cl.[5] ..... A63B 49/08; A63B 53/14

[52] U.S. Cl. ..... 273/73 J; 273/75; 273/81 R

[58] Field of Search ..... 273/81 R, 73 J, 75, 273/67 DA; 81/22, 489

[56] References Cited

U.S. PATENT DOCUMENTS

| | | | |
|---|---|---|---|
| 1,912,942 | 6/1933 | Kleinman | 273/75 |
| 2,124,534 | 7/1938 | Barnhart | 273/81 R |
| 2,133,696 | 10/1938 | Hall | 273/81 R |
| 3,501,148 | 3/1970 | Cheris et al. | 273/75 |
| 3,582,072 | 6/1971 | Stueck | 273/73 J |
| 3,833,218 | 9/1974 | Frenkel et al. | 273/73 J |
| 3,897,058 | 7/1975 | Koch | 273/81 R |
| 4,736,949 | 4/1988 | Muroi | 273/73 J |
| 4,811,947 | 3/1989 | Takatsuka et al. | 273/73 J |

FOREIGN PATENT DOCUMENTS

| | | | |
|---|---|---|---|
| 2186492 | 8/1987 | United Kingdom | 273/75 |

*Primary Examiner*—Edward M. Coven
*Assistant Examiner*—Steven B. Wong

[57] ABSTRACT

A shock absorbing racquet handle comprising a hollow grip with a butt plate secured on the rear end thereof, a roughly disk shaped elastic element secured within the front end of the grip, an elastic cover secured over the front end of the grip, a shaft extending through a central hole in the cover and elastic element with the rear end thereof in proximity to the rear end of the grip, and a positioning pin secured within the rear portion of the grip and extending through a lateral through hole formed near the rear end of the shaft with an elastic sheath disposed thereon. Wherein, a space is defined between the portion of the shaft to the rear of the elastic element and the inner wall of the grip, and the through hole of the shaft is concentric with the positioning pin passing therethrough with the diameter of the through hole being greater than the external diameter of the sheath on the positioning pin to define a space therebetween.

2 Claims, 1 Drawing Sheet

SHOCK ABSORBING RACKET HANDLE

BACKGROUND OF THE PRESENT INVENTION

The present invention relates to the structure of a shock and vibration absorbing racquet handle, and more particularly to a structure of a shock and vibration absorbing racquet handle for tennis racquets and the like, in which a shaft of the racquet handle structure is separated from a grip thereof by a space and can deflect laterally therein when a ball impacts the striking surface of a headframe attached therewith.

Through various types of shock and vibration absorbing racquet handle structures are known from the prior art, most utilize elastic, shock and vibration absorbing elements interposed between the shaft and grip thereof, with the length of the rear portion of the shaft engaged with the inner periphery of the grip therethrough.

In the shock and vibration absorbing racquet handle of the present invention, however, the rear portion of the shaft thereof is separated from the grip by an elastic element disposed in a front portion of the grip to define a space therebetween.

When a ball impacts the striking surface of a headframe attached to the racquet handle of the present invention, the shaft thereof deflects and pivots within the space between the shaft and grip to reduce the concomitant shock and slap transmitted to the grip and a user's hands, caused by the very rapid decceleration of the grip that would occur in a racquet with a shaft that was rigidly attached to the grip thereof.

Further, as the rear portion of the shaft is physically separated from the grip, concomitant vibrations in the headframe and shaft of the racquet could only be transmitted to the grip largely through the elastic element therebetween which is in contact with a relatively small area of the outer periphery of the shaft, with the vibrations being largely attenuated therein.

SUMMARY OF THE PRESENT INVENTION

The shock absorbing racquet handle of the present invention has as a main objective to provide a structure of a racquet handle that absorbs concomitant shock and vibration created when a ball impacts the striking surface of the racquet.

The shock absorbing racquet handle of the present invention comprises a hollow grip, an elastic element secured within the front end of the grip, a butt plate secured to the rear end of the grip, an elastic cover secured over the front end of the grip, a shaft extending through a central hole in the cover and elastic element with a forward end thereof adjoining with a headframe of the racquet and the rear end thereof in proximity to the rear end of the grip, and a positioning pin secured within a rear portion of the grip and passing through a lateral through hole formed on the shaft near the rear end thereof.

The elastic member is roughly disk shaped with recessed front and rear sides that slope inward toward each other from the outer periphery thereof. As such, the longitudinal width of the outer periphery of the elastic element, abutting the inner wall of the grip, is greater than the width of the central hole thereof, abutting the shaft passing therethrough.

The lateral through hole of the shaft and the concentric positioning pin passing therethrough are parallel with the plane of the headframe of the racquet.

An elastic sheath is disposed over the central portion of the positioning pin with the external diameter of the sheath being significantly smaller than the internal diameter of the through hole on the shaft to define a space therebetween.

A space is also defined between the portion of the shaft to the rear of the elastic element and the inner wall of the grip and butt plate.

The cover has a sharply tapered front portion with the central hole thereon abutting a relatively small area of the outer periphery of the shaft passing therethrough in comparison with the abutting area of the central hole of the elastic element.

When a ball impacts the striking surface in the headframe of the racquet, the shaft deflects in a perpendicular direction with respect to the plane of the headframe about a pivot point in a medial position between the elastic element and the positioning pin.

The maximum deflection of the shaft is limited by the through hole on the rear thereof and the positioning pin passing therethrough. The rear portion of the shaft can pivot in an opposite direction with respect to the forward end of the shaft until the inner wall of the through hole thereon abuts the sheath on the positioning pin.

The elastic element deforms upon the deflection of the shaft and quickly returns to its original shape to restore the shaft to its original orientation within the grip.

The deflection of the shaft upon the impact of a ball with the striking surface of the racquet strongly reduces the concomitant shock and slap that would be transmitted to a user's hands by a racquet with a rigidly connected shaft and grip.

As the shaft is separated from the grip by the space defined therebetween, and is engaged therewith only through the elastic member, elastic cover, and the elastic sheath of the positioning pin when in contact with the through hole thereon, concomitant vibrations in the headframe and shaft of the racquet, created by the impact of a ball with the striking surface thereof are largely prevented from reaching the grip and hands of a user as the above mentioned engaging elements are all made from elastic, vibration attenuating materials.

The main objective of the present invention is thereby achieved.

A detailed description of the structure and function of the shock absorbing racquet handle of the present invention along with accompanying drawings are given below.

A BRIEF DESCRIPTION OF THE DRAWINGS

PREFERRED EMBODIMENT OF THE PRESENT INVENTION

Figure 1:
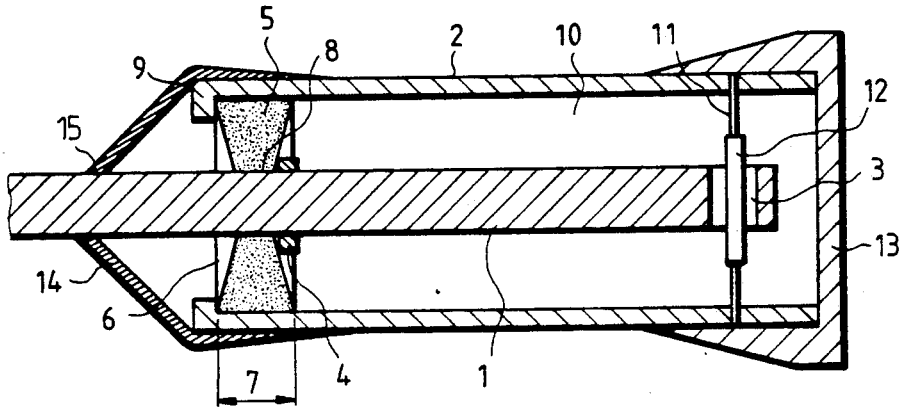
FIG. 1 is a sectional view of an embodiment of the shock absorbing racquet handle of the present invention taken along a plane parallel with a headframe (not shown) attached therewith.
Figure 2:
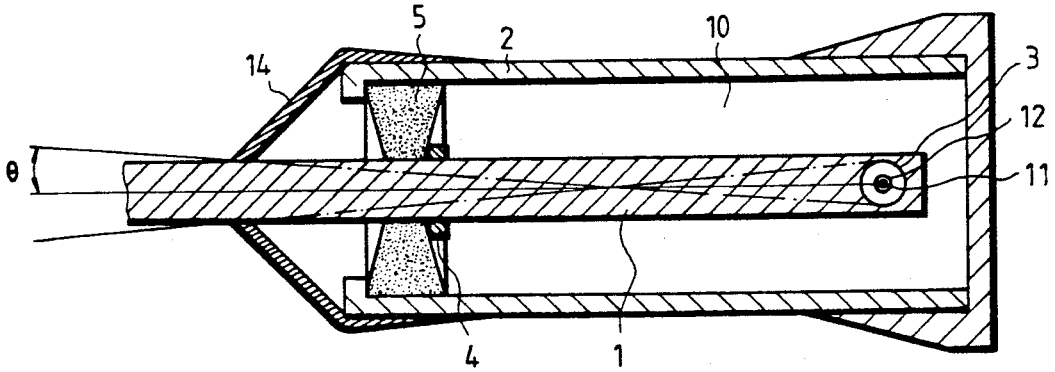
FIG. 2 is a sectional view of an embodiment of the shock absorbing racquet handle of the present invention taken along a plane perpendicular with a headframe (not shown) attached therewith.

Referring to FIGS. 1 and 2, the shock absorbing racquet handle of the present invention comprises a hollow grip 2 with an entrance formed on the front end thereof, a butt plate 13 secured on the rear end of grip 2, a generally disk shaped elastic element 5 secured within the front portion of grip 2, an elastic cover 14 secured over the front entrance of grip 2, a shaft 1 extending through a central hole 15 in cover 14 and a central hole 8 in elastic element 5 with the rear end thereof in proximity to the rear end of grip 2, and a positioning pin 11 secured within the rear portion of grip 2 and passing through a lateral through hole 3 formed near the rear end of shaft 1.

The forward end of shaft 1 is secured to a headframe of the racquet of which the racquet handle of the present invention is a part. The rear portion of shaft 1 to the rear of elastic element 5 is separated from the inner wall of grip 2 to define a space 10 therebetween.

Through hole 3 on shaft 1 is aligned in a parallel direction with respect to the plane of the headframe of the racquet.

Positioning pin 11 passes concentrically through through hole 3 with the ends thereof secured to respective lateral sides of the inner wall of grip 2. An elastic sheath 12 is disposed over the central portion of positioning pin 11 and has an external diameter substantially less than the diameter of through hole 3 on shaft 1, defining a space therebetween.

Elastic element 5 has recessed front and rear sides, 6*a* and 6*b*, that slope inwards towards each other from the outer periphery thereof, so that the longitudinal width 7 of the outer periphery of elastic element 5, abutting the inner wall of grip 2, is greater than the longitudinal width of the inner periphery of central hole 8, abutting the outer periphery of shaft 1, passing therethrough.

Elastic element 5 is secured within the front portion of grip 2 by a reentrant rim 9 formed around the front entrance thereof and a retaining ring 4 secured against the inner wall of grip 2, with rim 9 and retaining ring 4 abutting respective front and rear sides of elastic element 5.

Cover 14 has a sharply tapered front portion with central hole 15 thereon abutting the outer periphery of shaft 1 passing therethrough.

When a ball impacts the striking surface in the headframe of the racquet, shaft 1 deflects in a largely perpendicular direction with respect to the plane of the headframe about a pivot point in a medial position between elastic element 5 and positioning pin 11.

The maximum deflection of shaft 1 is limited to an angle by through hole 3 on the rear thereof and positioning pin 11 passing therethrough. The rear portion of shaft 1 to the rear of the pivot point can pivot through an angle in an opposite direction with respect to the forward end of shaft 1, whereupon the inner wall of through hole 3 thereon abuts sheath 12 on positioning pin 11.

Elastic element 5 deforms upon the deflection of shaft 1 and quickly returns to its original shape to restore shaft 1 to its original orientation within grip 2.

The deflection of shaft 1 upon the impact of a ball with the striking surface of the racquet strongly reduces the concomitant shock and slap that would be transmitted to a user's hands by a racquet with a rigidly connected shaft and grip.

As shaft 1 is separated from grip 2 by space 10 defined therebetween, and is engaged therewith only through elastic element 5, elastic cover 14, and elastic sheath 12 of positioning pin 11 when in contact with through hole 3 thereon, concomitant vibrations in the headframe and shaft 1 of the racquet, created by the impact of a ball with the striking surface thereof are largely prevented from reaching grip 2 and hands of a user as the above mentioned engaging elements are all made from elastic, vibration attenuating materials.

Moreover, elastic cover 14 is not a primary load bearing member and is not in firm contact with the outer periphery of shaft 1, and elastic sheath 12 on positioning pin 11 is in only momentary contact with shaft 1 when at maximum deflection. As such, elastic element 5 which is in firm contact with the outer periphery of shaft 1 and abuts a much greater surface area thereof than either elastic cover 14 or elastic sheath 12, forms the major path by which vibration in the headframe and shaft 1 can reach grip 2.

The inward sloping front and rear sides, 6*a* and 6*b*, of elastic element 5 serve to narrow the longitudinal width of the central hole 8 therein, and hence reduce the contact area with shaft 1 passing therethrough, while still providing an elastic element 5 that can position shaft 1 in relative lateral position within grip 2 with sufficient rigidity.

The reduction of contact area between elastic element 5 and shaft 1 correspondingly reduces the amount of vibration transmitted thereto.

Many variations and modifications to the shock absorbing racquet handle structure described above would occur to a person skilled in the art and all such modifications should be deemed to be within the spirit and scope of the present invention. As such the spirit and scope of the present invention should not be limited by the specificities of the above exposition but as defined by the appended claims.

Table of Drawings Numbers

1-shaft
2-grip
3-lateral through hole
4-retaining flange
5-elastic element
6*a*-recessed front side
6*b*-recessed rear side
7-width of outer periphery of elastic element
8-central hole
9-reentrant rim
10-space
11-positioning pin
12-elastic sheath
13-butt plate
14-cover
15-central hole

I claim:

1. A shock absorbing racquet handle structure comprising:

a hollow grip with a front entrance formed on the front end thereof;

a butt plate provided on the rear end of said grip;

an elastic element having recessed front and rear sides sloping inwardly towards each other from the outer periphery of said elastic element and a central hole formed therein, said elastic element being secured within a front portion of said grip;

an elastic cover with a central hole formed therein secured over said front entrance of said grip;

a shaft extending through said central hole of said cover and said central hole of said elastic element and abutting therewith, with the rear end of said shaft in proximity to the rear end of said grip, and the rear portion of said shaft to the rear of said elastic element being separated from the inner wall of said grip to define a space therebetween;

a lateral through hole formed in proximity to the rear end of said shaft and being aligned in a substantially parallel direction with respect to the plane of a headframe attached to said shaft of said racquet handle;

a positioning pin passing concentrically through said through hole on said shaft with the ends thereof secured to respective lateral sides of the inner wall of said grip;

an elastic sheath disposed over the central portion of said positioning pin with an external diameter less than the diameter of said through hole of said shaft, defining a space therebetween.

2. A shock absorbing racquet handle structure according to claim 1, wherein said elastic element is secured within the front portion of said grip by a reentrant rim formed around said front entrance thereof and a generally ring shaped retaining element secured against the inner wall of said grip, with said rim and said retaining element abutting respective said front and rear sides of said elastic element.

* * * * *